United States Patent [19]

Trenne

[11] 4,200,067

[45] Apr. 29, 1980

[54] HYDRAULIC VALVE ACTUATOR AND FUEL INJECTION SYSTEM

[75] Inventor: Myron U. Trenne, Rochester, Mich.

[73] Assignee: General Motors Corporation, Detroit, Mich.

[21] Appl. No.: 901,715

[22] Filed: May 1, 1978

[51] Int. Cl.[2] ..... F01L 9/04; F02B 75/02

[52] U.S. Cl. ..... 123/90.12; 123/90.11; 123/90.13; 123/139 AW; 123/32 VN

[58] Field of Search ..... 123/90.11, 90.12, 90.15, 123/139 AW, 139 BD, 90.13, 32 VN, 140 FG; 417/254

[56] References Cited

U.S. PATENT DOCUMENTS

| | | | |
|---|---|---|---|
| 2,011,864 | 8/1935 | Lundh | 123/90.12 |
| 2,429,932 | 10/1947 | Gehres | 123/139 AW |
| 2,598,528 | 5/1952 | French | 123/32 JV |
| 2,827,884 | 3/1958 | Stivender | 123/90.12 |
| 2,898,901 | 8/1959 | Glenn | 123/139 AW |
| 2,915,052 | 12/1959 | Gullen | 123/90.11 |
| 2,955,582 | 10/1960 | Taylor et al. | 123/139 AW |
| 3,094,976 | 6/1963 | May | 123/139 AW |
| 3,257,999 | 6/1966 | Fiedler | 123/90.12 |
| 3,682,152 | 8/1972 | Muller-Berner | 123/90.11 |
| 3,727,595 | 4/1973 | Links | 123/90.12 |
| 3,861,833 | 1/1975 | Salzgeber et al. | 417/254 |
| 3,865,088 | 2/1975 | Links | 123/90.12 |
| 3,926,159 | 12/1975 | Michelson et al. | 123/90.11 |
| 4,009,695 | 3/1977 | Ule | 123/90.13 |

*Primary Examiner*—Charles J. Myhre
*Assistant Examiner*—Jeffrey L. Yates
*Attorney, Agent, or Firm*—Arthur N. Krein

[57] ABSTRACT

A hydraulic valve actuator and fuel injection system for an internal combustion engine includes an engine driven pump, similar to a diesel fuel metering and distributing pump, which is used to sequentially supply pressurized fuel to each of a plurality of hydraulic actuator plungers positioned to effect opening movement of an associated normally closed inlet valve of the engine, the hydraulic line to each actuator plunger having a solenoid valve associated therewith for controlling flow from the hydraulic line to a relatively low pressure drain conduit whereby to control inlet valve lift duration. Each actuator plunger, during inlet valve opening movement, is used to pressurize liquid fuel for injection into the induction fluid flow to an associated combustion chamber of the engine. In one embodiment, one end of the actuator plunger and one end of its associated actuator cylinder functions as a variable displacement fuel pump supplying fuel to an injection nozzle, and in an alternate embodiment, each actuator plunger is operatively coupled to an associated unit type fuel injector to effect operation thereof.

5 Claims, 3 Drawing Figures

HYDRAULIC VALVE ACTUATOR AND FUEL INJECTION SYSTEM

FIELD OF THE INVENTION

This invention relates to internal combustion engines and, in particular, to a hydraulic valve actuator and fuel injection system for controlling the valve operation in such an engine and for effecting injection of fuel to the engine as a function of valve actuation.

DESCRIPTION OF THE PRIOR ART

In Applicant's copending United States patent application Ser. No. 901,452 entitled "Hydraulic Valve Actuator System" filed concurrently herewith on May 1, 1978, there is disclosed a hydraulic valve actuator system that is operative for use with, for example, the intake valves of an engine to control engine breathing via independent control of valve lift, valve duration, and valve timing. Thus, with this type hydraulic valve actuator system, intake valve throttling can be readily used to thereby provide a sonic throttling intake valve engine that is operable in a manner as disclosed, for example, in U.S. Pat. No. 3,422,803 entitled "Internal Combustion Engine Construction and Method for Operation with Lean Air-Fuel Mixtures" issued Jan. 21, 1959 to Donald L. Stivender.

However, using a hydraulic valve actuator system of the type disclosed in the above-identified application Serial No. to achieve full range engine throttling for reducing engine pumping losses creates a need for a fuel metering system that is compatible therewith and which is operative in the absence of a manifold signal, as is otherwise normally available in the usual throttle valve controlled engine induction system.

SUMMARY OF THE INVENTION

This invention relates to a hydraulic valve actuator system for operation of the intake valves of an internal combustion engine and to a positive displacement fuel metering injection system that is operated by the hydraulic actuators of the hydraulic valve actuator system for the injection of fuel as a function of a valve lift.

A primary object of this invention is to provide a hydraulic valve actuator and fuel injection system for an internal combustion engine whereby inlet valve lift, timing and duration are controlled, as desired, by a hydraulic valve actuator system and whereby fuel injection is also controlled by the hydraulic valve actuators of the system.

Another object of this invention is to provide a hydraulic valve actuator and fuel injection system that is operable to provide improved control of engine breathing and induction of fuel therein over all engine speed and load operating conditions.

A further object of this invention is to provide a hydraulic valve actuator and fuel injection system whereby an internal combustion engine can be operated by controlling engine power output via inlet valve control by means of hydraulic valve actuators which are also operative to effect fuel injection into the engine as a direct function of the operation of these hydraulic valve actuators.

For a better understanding of the invention as well as other objects and further features thereof, reference is had to the following detailed description of the invention to be read in connection with the accompanying drawings, wherein:

DESCRIPTION OF THE PREFERRED EMBODIMENT

Figure 1:
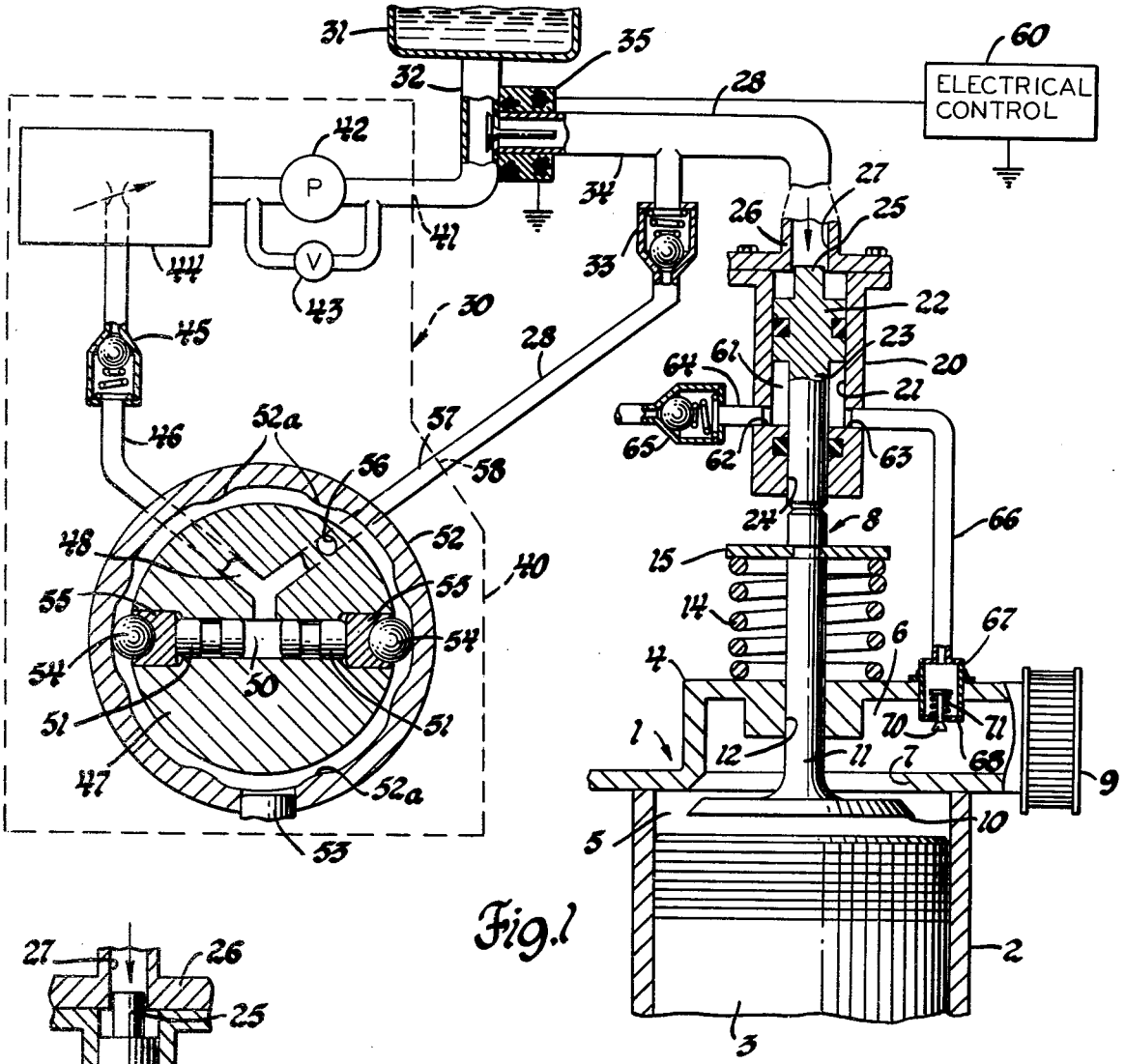
FIG. 1 is a schematic illustration of a portion of an internal combustion engine having a hydraulic valve actuator and fuel injection system, in accordance with a preferred embodiment of the invention incorporated therein.

Referring now to FIG. 1, there is shown schematically a portion of an internal combustion engine 1 having, in the construction illustrated, a plurality of longitudinally aligned cylinders 2, only one of which is shown, each such cylinder 2 having reciprocably disposed therein a piston 3 operatively connected to the engine crankshaft, not shown. Mounted on the cylinder block and enclosing the upper ends of the cylinders 2 is a cylinder head 4 which cooperates with the cylinders to define combustion chambers 5 and includes inlet or induction passages 6, each of which terminates at one end in an inlet port 7 opening into an associated combustion chamber 5. Each such port 7 is closeable by an outward opening inlet valve 8. As is well known, the inlet passages 6 may be formed in part by an inlet manifold having a common inlet with an air filter 9 attached thereto.

Each inlet valve 8 is of conventional poppet type construction and includes a valve head 10 with a valve stem 11 extending therefrom that is suitably journaled and guided in a valve stem guide bore 12 in the cylinder head 4 whereby the head 10 of the inlet valve can be moved into and out of engagement with the valve seat encircling and forming part of an inlet port 7. Each such inlet valve 8 is normally biased to a closed position relative to its associated port 7 by means of a valve return spring 14 bearing upwardly from the cylinder head 4 against a spring retainer 15 locked, in a well known manner, to the valve stem 11 closely adjacent to its free end.

Suitably supported above each of the inlet valves 8 is a hydraulic actuator means that includes an actuator housing 20 which may be formed as part of the cylinder head 4 or, as shown, as a separate element. Housing 20 is provided with hydraulic valve actuator cylinders 21 therein, the axis of each such actuator cylinder 21 being aligned with the axis of the valve stem 11 of the inlet valve 8 with which it is associated. An actuator plunger or piston 22 is reciprocably journaled in each of the actuator cylinders 21, whereby each such actuator cylinder 21 and actuator piston 22 forms, in effect, a valve actuator. Each actuator piston 22 is suitably structured so that one end thereof, its lower end with reference to FIG. 1, operatively abuts against the free end of the valve stem 11 with which it is associated. Thus, in the construction illustrated, each actuator piston 22 has a reduced diameter extension 23 at its lower end that slidably projects outward through an opening 24 provided in the lower end of the actuator housing 20 in axial alignment with the associated actuator cylinder 21. Also in the construction illustrated, each actuator piston 22 is provided at its opposite or upper end with a pilot plunger 25 of predetermined diameter and axial length for a purpose to be described.

Each actuator cylinder 21 in the housing 20 is partly closed at its upper end by a housing cylinder head 26 having a passage 27 therethrough, opening into that actuator cylinder 21. This end of each passage 27 opening into an actuator cylinder 21 is of a predetermined internal diameter so as to loosely receive the pilot plunger of the associated actuator piston 22. The opposite end of each passage 27 is suitably connected to one end of an associated delivery conduit 28 whereby the upper end of an associated actuator cylinder can be intermittently supplied with a metered quantity of hydraulic fluid, such as oil, in a manner to be described, whereby, as a predetermined hydraulic force is applied against the actuator piston 22, it will be moved in a power stroke direction, downward with reference to FIG. 1, to effect opening movement of the inlet valve 8, and when this force is reduced sufficiently, the valve return spring 14 will affect reseating or closure of the inlet valve 8 and, at the same time, cause movement of the actuator piston 22 in a return stroke direction.

In the embodiment of the hydraulic valve actuator structure disclosed, pressurized hydraulic fluid is intermittently supplied to each actuating cylinder 21 via its associated delivery conduit 28 by an engine driven distributor pump, generally designated 30, which in turn is supplied with hydraulic fluid from a fluid reservoir 31 via a supply conduit 32.

Each delivery conduit 28 is connected intermediate the one-way check valve 33 controlling flow through this conduit and its connection to an associated actuator cylinder 21 by a drain conduit 34 to the supply conduit 32 intermediate the ends thereof, with flow through the drain conduit 34 to the supply conduit 32 being controlled by a normally opened, solenoid valve 35.

For a purpose which will become apparent, the fluid reservoir 31 should either be located in the manner shown to act as an accumulator to provide a slightly pressurized column of fluid in the supply conduit 32 so as to prevent complete drainage of fluid from the associated delivery conduit 28 when the associated solenoid valve 35 is open or alternately, the fluid reservoir 31 should be in the form of a low pressure type accumulator chamber, not shown. As a further alternate, the fluid reservoir 31 can be located as desired and a low pressure supply pump, not shown, can be used to deliver fluid from the fluid reservoir 31 to the pump 30 through the supply conduit 32 at a predetermined low supply pressure in the same manner as currently used in certain diesel engine powered vehicles. In this second alternate construction, such a supply pump should be located, for example, in the supply conduit 32 up stream of the solenoid valve 35 controlled flow opening from the drain conduit 34 thereto.

Distributor pump 30 may be any suitable type positive displacement pump such as those presently available for use in diesel fuel injection systems. Accordingly, the distributor pump 30 may be of the type disclosed in U.S. Pat. No. 3,648,673 entitled "Fuel Injection Pump" issued Mar. 14, 1972 to Richard S. Knape or, as schematically shown, the pump may be of the type disclosed, for example, in U.S. Pat. No. 3,861,833 entitled "Fuel Injection Pump" issued Jan. 21, 1975 to Daniel Salzgerber, Robert Raufeisen and Charles W. Davis. This later type pump is, in effect, an engine driven inlet-metering, distributor type pump having a built-in governor and automatic advance mechanism whereby the pump is operative to provide timed delivery of metered quantities of pressurized fluid as a function of engine operation as controlled by an operator in a known manner.

As is known, a pump of the type disclosed in the above identified U.S. Pat. No. 3,861,833 includes a pump housing 40 having an inlet 41 connected to the common supply conduit 32 through which fluid flows to an internal transfer pump 42. Since the displacement of the transfer pump 42 greatly exceeds final pump 30 discharge requirements, a large percentage of fluid delivered by the transfer pump is by-passed back to the inlet side of the transfer pump 42 through a by-pass means having a pressure regulating valve 43 therein which causes both the amount of fluid by-passed and transfer pump 42 discharge pressure to increase with engine speed. A portion of the fluid discharged from the transfer pump is forced through a metering valve 44, as regulated by engine demand through a governor arrangement, not shown. From the metering valve 44, fluid flows through a check valve 45 in a passage 46 to a distributor rotor 47 rotatably journaled in housing 40 and driven in a suitable manner, not shown, by engine 1, as is the transfer pump 42. With this arrangement, pump operation is synchronous with engine 1 operation. When one of the charging port passages 48 in the rotor 47 comes into register with the passage 46, fluid flows into the injection pump chamber 50 in rotor 47.

The injection pump chamber 50 is formed by a pair of intersecting transverse bores in the rotor 47. A pair of opposed plungers 51 are mounted for reciprocating movement in these bores. Surrounding the distributor rotor 47 is a generally annular internal cam ring 52, which, in turn is journaled in housing 40 for limited arcuate movement and is moved by means of an advanced mechanism, not shown, to which it is operatively connected by means of a connecting pin 53. The advanced mechanism, not shown, is operative whereby delivery of fuel by the injection pump from the injection pump chamber 50 will be varied as a function of engine operation. Cam rollers 54 and cam roller shoes 55 are carried by the rotor 47 between the plungers 51 and the cam ring 52.

When metered fuel is admitted to the injection pump chamber 50, the plungers 51 move radially outward, as required, to receive the charge of fluid delivered thereto. At that time, the cam rollers 54 are positioned between adjacent cam lobes **52*a* of the cam ring 52. Rotation of rotor 47 then causes the charging port passage 48 to pass out of registry with passage 46 and, as the distributing passage 56, shown schematically, comes into registry sequentially with one of a plurality of passages 57 to the outlets 58, cam rollers 54 simultaneously contact opposite lobes 52*a* of the cam ring 52 to effect reciprocable motion of the plungers 51 so as to pressurize the charge of fluid in the injection pump chamber 50 on the inward stroke of the plungers 51 to some predetermined high pressure. This pressurized fluid is, of course, then discharged via one of the passages 57 to its associated outlet 58 that, in turn, is connected to a delivery conduit 28, previously described. it should be noted that only one of the passages 57 and only one of the outlets 58 is shown in FIG. 1, it being realized that an N number of such passages and an N number of associated outlets would be provided on a particular embodiment of the distributor pump 30** for a particular engine application having an N number of cylinders.

It is believed that the foregoing description is sufficient for the purpose of this application to show the general operation of this particular type engine driven distributor pump 30. For further details concerning the specific construction of this type distributor pump 30, as shown, reference is made to the above-identified U.S. Pat. No. 3,861,833, the disclosure of which is incorporated herein by reference thereto.

For purposes of disclosure only, the engine 1 may be referred to as a V-8 engine. it will thus be apparent that in such an engine there would be two banks of cylinders 2 and that the total of N number of cylinders in this engine would be eight. Such an engine would be provided with at least an N number or eight inlet or intake poppet valves and at least an N number or eight outlet or exhaust poppet valves for controlling ingress of induction fluid to the cylinders 2 and egress of exhaust gas from the cylinder. It will also be apparent to those skilled in the art, that the exhaust valves, not shown, can be either operated by a hydraulic valve actuator system, as thus far described, or they can be operated by any well known valve train mechanism, as desired.

Referring again to the hydraulic valve actuator portion of the system thus far described, it is preferred that the check valves 33 and solenoid valves 35 are located in close proximity to the distributor pump 30 so that, in effect, a single hydraulic line is required to connect each remote valve actuator to the distributor pump 30. This hydraulic line is thus operative to accommodate fluid flow in both directions to facilitate valve opening and valve closing.

As previously described, the accumulator or reservoir 31 is operatively connected to each pump outlet check valve 33 and associated valve actuator by a normally open solenoid valve 35. Each such solenoid valve 35 is a normally open, so-called poppet type valve and it is used in such a manner so as to utilize the greatest magnetic holding force in the valve closed position and so as to release, when de-energized, very quickly due to hydraulic pressure attempting to unseat the valve thereof. As will be apparent, each solenoid valve 35 would be connected to a suitable source of electrical power, not shown, through a suitable valve timing electrical computer control device, hereinafter referred to as an electronic control device 60, whereby these solenoid valves 35 can be sequentially energized and then de-energized in a predetermined manner, as desired, as a function of engine operation as controlled by operator input. Since the details of a suitable electronic control device 60 and its operation is not deemed necessary for an understanding of the subject invention, such a device has not been described herein, especially in view of the fact that such control devices are well known in the electronic art as associated with the fuel injection and hydraulic valve control systems, for example, of automotive engines as shown, for example, in U.S. Pat. Nos. 3,240,191 Wallis and 3,817,099 Bubniak et al.

As previously described, each valve actuator, consists of a hydraulic piston 22 that is operative to generate a downward force on an associated inlet valve 8 when fluid pressure is applied to the upper end, with reference to FIG. 1 of the piston 22. The applied fluid pressure is predetermined and is always sufficient to overcome resisting forces of the valve return spring 14, friction, and cylinder pressure because of the positive displacement nature of the system. The use of a valve actuator in conjunction with a conventional valve return spring 14, provides, in effect, a hydraulic pump on the return stroke of the inlet valve 8. Thus, hydraulic energy is conserved by storing the energy return on the return stroke of the valve actuator in the pressure accumulator or reservoir 31. It will readily be apparent that the valve return spring 14 should have sufficient force to assure that the inlet valve 8 will fully return to its closed position and so that it can not be unseated by residual pressure in the conduit 28 when the associated solenoid valve 35 is open. The pilot plunger 25, previously described, is included on the actuator piston 22 so as to orifice the flow of fluid from the actuator cylinder 21 during the final portion of the return stroke of the actuator piston 22 therein whereby to provide a hydraulic cushion for gentle seating of the inlet valve 8 against its valve seat and to effect a reduction in noise.

In the operation of the hydraulic valve actuator portion of the subject system, inlet valve lift control and valve timing control is achieved by normal operation of the engine driven, distributor pump 30, while inlet valve duration control is achieved by operation of the solenoid valves 35, as follows:

VALVE LIFT CONTROL

Figure 3:
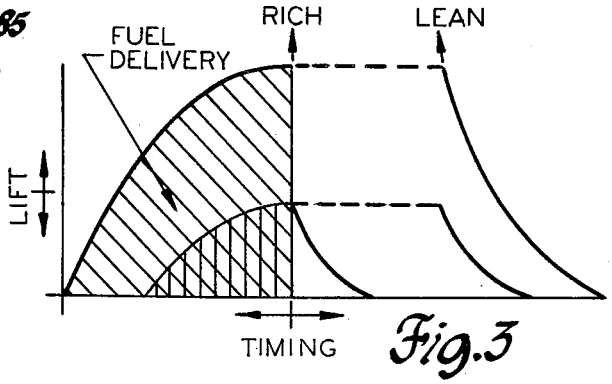

Inlet valve lift control is achieved in the subject system through the operation of the metering valve 44 of the distributor pump 30. The quantity of fluid admitted by the metering valve during the suction stroke of plungers 51 determines the amount of inlet valve 8 displacement per stroke in a 1:1 manner. The inlet valve 8 lift will thus occur in a manner that maintains the maximum lift point in a constant relationship to piston 3 position. Thus, at a given time setting, maximum valve lift will always occur at the same point (e.g., 90°) regardless of amount of lift as shown in FIG. 3. This feature provides inherent advance of valve opening as greater valve lifts are generated in response to system controls.

VALVE TIMING CONTROL

Inlet valve timing control in the subject system is achieved by rotation of the cam ring 52 with respect to the engine crankshaft in a manner described in detail in the above-identified U.S. Pat. No. 3,861,833. Movement of the cam ring 52 sets the point when the plungers 51 contact the cam lobes **52*a* at which time lift of an engine valve 8 begins. Although a particular mechanism has been shown in the above-identified U.S. Pat. No. 3,861,833 to effect rotation of the cam ring 52 as a function of engine operation, various other types of vacuum or electrical actuators can be used, as known in the art, to effect rotation of such a cam ring 52 in this type distributor pump 30**.

VALVE DURATION CONTROL

Inlet valve duration control is achieved by the associated solenoid valve 35 for each inlet valve 8. The electronic control device 60 is operative so that the solenoid valve 35 must be energized (closed) when its asociated inlet valve 8 lift begins. When maximum valve lift is attained, the distributor pump 30 output check valve 33 locks a holding pressure on the associated valve actuator and holds that associated inlet valve 8 open against the force of its valve return spring 14. When this solenoid valve 35 is de-energized, the hydraulic lock is lifted and then the associated valve return spring 14 is operative to return that inlet valve 8 to its seated or closed position, and at the same time to act against the associated actuator plunger 22 to effect a return stroke thereof whereby to force the fluid back to the accumulator or reservoir 31. Thus, the valve lift profile follows the profile of the cam lobes 52*a* as seen in FIG. 3 and valve opening time become a function of engine speed. In contrast, valve closing time is a hydraulic function that remains constant over the engine speed range. Inlet valve duration control, as shown in FIG. 3, simply delays hydraulic release for the desired time or degrees of crankshaft position.

Since the hydraulic valve actuator portion of the subject system thus far described is the same as the hydraulic valve actuator system disclosed in the above-identified U.S. patent application Ser. No. 901,452, a further description of the various modes of operation of the intake valves 8 and of the exhaust valves of an engine equipped with these systems is not deemed necessary for an understanding of the subject invention, especially since the disclosure of copending application Ser. No. 901,452 is incorporated herein by reference thereto.

Now in accordance with the preferred embodiment of the invention, the lower end of each actuator cylinder 21 and the lower end of each actuator plunger 22, with its extension 23, associated with an inlet valve 8 are properly sized as to diameters and relative axial extent so as to provide a variable volume fuel pump chamber 61. Housing 20 is also provided with inlet ports 62 opening into each pump chamber 61 and with corresponding discharge ports 63 from each of these chambers 61. Each inlet port 62 is connected via a fuel conduit 64, with an inlet check valve 65 therein, to a source of low pressure fuel, as supplied by a conventional fuel pump, not shown, from the usual fuel reservoir, not shown.

Each discharge port 63 is connected by a fuel delivery passage or conduit 66 to a fuel injector nozzle 67 suitably fixed, for example, to the cylinder head 4 so that its apertured spray tip 68 end is positioned to discharge fuel into the associated inlet passage 6 upstream of the associated inlet port 7.

Although the fuel injector nozzle 67 may be of any suitable type with either an inward or outward opening valve controlling fuel discharge therefrom, in the construction shown this fuel injector nozzle 67 is of the poppet type having an outward opening poppet valve 70 that is normally biased to its closed position by means of a spring 71 of predetermined force, as desired.

The fuel pump, not shown, should be of a type to supply fuel at a sufficient pressure so as to prevent fuel vapor formation in the pump chambers 61 and injector nozzles 67, but this initial supply pressure should be insufficient to effect opening of the poppet valves 70 of the injector nozzles 67. During engine operation, when an actuator plunger 22 moves upward on a return stroke during inlet valve 8 closing, fuel is supplied via conduit 64 and check valve 65 to the associated pump chamber 61. When this actuator plunger 22 is then moved downward by application of pressurized hydraulic fluid to its opposite or upper end, the lower end of this actuator plunger 22 will effect a pump stroke to further pressurize the fuel trapped therein by closure of inlet check valve 65 and to effect positive displacement of the fuel at a suitable pressure, as desired, from the pump chamber 61 out through the associated discharge port 63 and conduit 66 to the associated injector nozzle 67 whereby to effect outward opening movement of poppet valve 70 against the bias of spring 71 to permit discharge of fuel out through the spray tip 68 into the induction passage 6.

Figure 2:
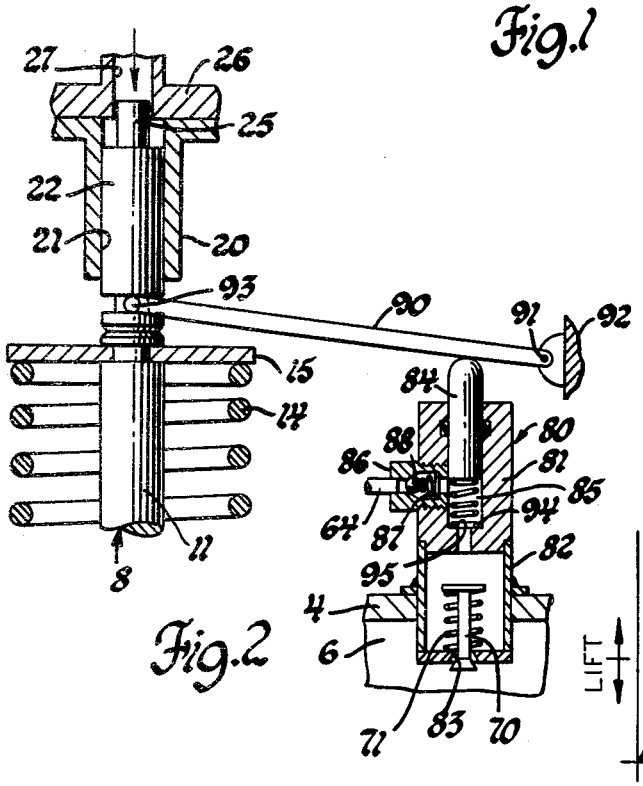
FIG. 2 is a schematic illustration, similar to a portion of FIG. 1, showing an alternate embodiment of a fuel injection system in accordance with the invention; and, FIG. 3 is a generalized set of curves of valve lift and fuel flow versus valve timing showing the intended application of the subject hydraulic valve actuator and fuel injection system in an engine.

An alternate embodiment of the fuel injection portion of the hydraulic valve actuator and fuel injection system in accordance with the invention is shown in FIG. 2 wherein similar parts are designated by similar numerals. In this alternate embodiment, separate unit fuel pump-injector nozzles, generally designated 80, of the so-called jerk type unit injector, are used to effect pressurization and injection of fuel into the inlet passages 6, with each of these unit injectors being operatively connected for actuation by an associated actuator plunger 22 or its associated inlet valve 8 during movement thereof.

Thus, in the construction schematically shown, each unit fuel pump-injector nozzle 80 includes a housing means having a pump body 81 and nozzle valve body 82 suitably secured together and fixed to the cylinder head 4 so that the apertured spray outlet 83 of the nozzle valve body 82 is positioned for discharging fuel into an associated inlet passage 6 upstream of its inlet port 7.

Pump body 81 is provided with a stepped bore therein to form with a pump plunger 84 reciprocably journaled therein a pump chamber 85 which is in fluid communication with the interior of the nozzle valve body 82 and its spray outlet 83 as controlled by an outward opening poppet valve 70 that is normally held in its closed position by a spring 71. Fuel is supplied to the pump chamber 85 through an inlet fitting 86, suitably provided on pump body 81, which has a spring 87 biased check valve 88 therein, this inlet fitting 86 being connected by a fuel conduit 64 to a source of low pressure fuel, as supplied, for example, by a low pressure supply pump.

In the construction shown, pump plunger 84 is moved in one direction, downward with reference to FIG. 2, to effect a pump stroke by means of a pivot lever 90 pivotally supported at one end by a pivot pin 91 carried by a fixed support member 92. The opposite, bifurcated end of the pivot lever 90 is suitably connected as by a pivot drive pin 93 to a reduced diameter portion of the actuator plunger 22 extending outward from its actuator cylinder 21 so as to be driven thereby. As shown, the pivot lever 90, at a predetermined location thereof, abuts against the upper end of the pump plunger 84 extending outward from the pump body 81 whereby to effect a predetermined axial movement or pump stroke of the pump plunger 84 relative to a predetermined axial downward movement of the actuator plunger 22 effecting inlet valve 8 opening movement. Movement of the pump plunger 84 in the opposite direction to effect a suction stroke, in the construction shown, is by means of a spring 94 positioned in the pump chamber 85 with one end thereof in abutment against an internal radial shoulder 95 of pump body 81 and its opposite end in abutment against the lower end of the pump plunger 84.

With the pump structure just described, the length of stroke of the pump plunger 84 is directly proportional, as desired, to the axial displacement of the actuator plunger 22 effecting opening movement of the associated inlet valve 8 and, therefore, the quantity of fuel pressurized and injected out through the spray tip 83 into the inlet passage 6 from operation of the unit fule pump-injector nozzle 80 is proportional to the lift of inlet valve 8.

It will now be apparent to those skilled in the fuel injection art, that in both fuel injection embodiments disclosed, the effective fuel pump working areas of both the actuator plunger 22 and pump plunger 84 are preselected so as to provide for the injection of the desired quantity of fuel for a particular size engine.

OPERATION

In both embodiments of the hydraulic valve actuator and fuel injection system described, fuel injection is inherently timed to occur during lift of the associated inlet valve 8, as shown in the graph of FIG. 3. At engine idle conditions, the fuel injection will be relatively slow but the air flow through the restricted inlet valve 8 controlled inlet port 7 will be turbulent to cause good mixing. At higher engine speeds, fuel injection occurs relatively fast. In either case, more than half of the induction air flow into the combustion chamber 5 follows the completion of fuel injection to provide consistent intake and mixing of the fuel and air.

While the concept of fuel injection related to valve lift, as disclosed, assumes a fundamentally linear relationship between inlet valve 8 lift and the mass of air taken into the associated combustion chamber 5, a wide range of control can be derived via the inlet valve 8 opening duration control, as shown by the graph of FIG. 3.

Thus, fuel for injection into the engine cylinder is metered proportional to inlet valve 8 lift by either controlled axial movement of the actuator plunger 22 having its lower end operating as a fuel metering pump, as in FIG. 1, or by the variable stroke of the pump plunger 84, as shown in FIG. 2. The inlet air is metered based on sonic flow through the inlet port 7 as controlled by inlet valve 8 for a specific duration of engine crank angle, as described in the above-identified U.S. Pat. No. 3,422,803. Thus, it will be apparent that in the subject systems disclosed herein, the air flow rate and the quantity of fuel delivered are directly proportional to inlet valve 8 lift. A fine timing control of the total mass of air is then possible by controlling the duration of inlet valve 8 opening, as desired. It will be seen that the air flow rate times engine crankshaft, not shown, crank angle (time at a known engine RPM) can be used to determine the mass of air taken into the combustion chamber 5 so that the electronic control device 60 can be programmed, as desired, to provide for the desired engine performance.

Thus, as shown by the graph of FIG. 3, with zero delay of inlet valve 8 closing, a minimum quantity of air is admitted to the combustion chamber 5 creating a rich air-fuel mixture therein. Adding controlled delay of inlet valve 8 closing will lean out the air-fuel mixture, as desired, by sustaining the induction air flow for a greater period of time. This continuation of air flow after fuel delivery has stopped will effect purging of fuel vapor from the inlet port 7 and, depending on the length of this delay period, can produce some stratification of the charge in the combustion chamber.

The embodiments of the invention in which an exclusive property or privilege is claimed are defined as follows:

1. A hydraulic valve actuator and fuel injection system for use in an internal combustion engine having an engine housing means with an N number of cylinders each with a piston therein connected to the crankshaft of the engine, said housing means having induction passage means therein connected by inlet ports to said cylinders, an N number of spring biased, normally closed inlet valves controlling flow through said inlet ports, said hydraulic valve actuator and fuel injection system including a source of hydraulic fluid, an N number of cylinder means in said housing means, a hydraulic actuator piston in each said cylinder means operatively connected to one of said inlet valves, a distributor type, liquid pump having an inlet connected to said source of hydraulic fluid and an N number of outlets, an N number of conduit means each with a one-way valve therein connecting said outlets to said cylinder means, said pump being operatively connected to said crankshaft to be driven thereby for delivering measured charges of hydraulic fluid under high pressure sequentially to said cylinder means on the side of said actuator pistons opposite said valve, an N number of branch conduit means each with a normally, open solenoid valve operatively connectable to a source of electrical power controlling flow therethrough, each said branch conduit means being connected at one end to one of said conduit means intermediate said one-way valve and its associated cylinder means and at its other end being in flow communication with said source of hydraulic fluid, fuel supply means, an N number of fuel injection nozzles, each of said fuel injection nozzles being positioned to discharge fuel into an associated said induction passage means upstream of an associated one of said inlet ports, an N number of fuel pressurizing means each having a fuel inlet connected to said fuel supply means and a fuel outlet connected to its associated one of said fuel injection nozzles, each said fuel pressurizing means being operatively associated with one of said actuator pistons whereby to supply pressurized fuel to an associated fuel injection nozzle as an associated said inlet valve is open by an associated said actuator piston.

2. A hydraulic valve actuator and fuel injection system for controlling the opening and closing of a set of inlet valves associated with the induction passages to the cylinders of an internal combustion engine wherein the inlet valves are normally closed by springs and for injecting fuel to the cylinders, said system including a set of actuator cylinders each with an actuator piston slidable therein for engagement with one of said inlet valves to effect movement of said one of said inlet valves when said actuator piston is reciprocated in a first direction, fluid delivery means for delivering fluid to said actuator cylinders to the end of said actuator pistons opposite said valves, said fluid delivery means including a low pressure fluid supply means, an engine driven high pressure, metering pump means having an inlet connected to said fluid supply means and a set of outlets and separate supply conduit means connecting said outlets to said actuator cylinders, and a set of normally open, solenoid valve controlled drain conduit means operatively connecting each of said supply conduit means to said fluid supply means, said metering pump means including metering and timing means for controlling the output and timing of output of said metering pump means to control said inlet valve lift and timing, respectively, of the lift of said inlet valves, each said solenoid valve being operatively connectable to a controlled source of electrical power whereby to control duration of opening of said inlet valves, a corresponding set of fuel injector nozzle means, each said fuel injector nozzle being positioned to discharge fuel into an associated one of said induction passage, a set of fuel pressurizing means, each said fuel pressurizing means having an inlet connectable to a source of fuel and an outlet connected to one of said fuel injector nozzles and operable as a function of an associated said actuator piston movement opening an associated said inlet valve to pressurize and deliver fuel to an associated said fuel injector nozzle whereby fuel is injected into the associated said induction passage while the said inlet valve associated therewith is open.

3. A hydraulic valve actuator and fuel injection system according to claim 2 wherein each said fuel pressurizing means is provided by one end of each said actuator cylinders and said actuator piston slidable therein on the end thereof next adjacent the associated said inlet valve.

4. A hydraulic valve actuator and fuel injection system according to claim 2 wherein each said fuel pressurizing means includes a separate pump having a pump body and pump plunger slidable therein operatively connected to an associated fuel injector nozzle and a lever means operatively connected to said pump plunger and to its associated said actuator piston whereby said pump plunger is moved on a pump stroke when said actuator piston is hydraulically moved in a direction to effect opening movement of its associated said inlet valve.

5. A hydraulic valve actuator and fuel injection system to effect movement of an N number set of spring biased, normally closed inlet valves of an engine controlling flow of induction fluid through associated induction passages and for injection of fuel into each of these induction passages, said system including an N number of valve actuator means each having an actuator piston reciprocably journaled in an actuator cylinder for operative engagement with an associated one of said inlet valves, a source of hydraulic fluid, an engine driven distributor type pump means having inlet means connected to said source of hydraulic fluid and providing an N number of outlets, said pump means being operative to deliver measured changes of liquid under high pressure sequentially to said outlets in timed relation to the operation of the engine, an N number of delivery conduit means, each said delivery conduit means being connected at one end to one of said outlets and at its other end operatively connected to as associated said actuator cylinder and each having a check valve therein positioned closely adjacent to an associated said outlet, an N number of drain passage means each having a normally open, solenoid valve connectable to an engine electrical control circuit for controlling flow through its associated drain passage means, each said drain passage means being connected in fluid communication at one end to one of said delivery conduit means intermediate the associated said check valve therein and the associated said actuator cylinder and at its other end to said source of hydraulic fluid whereby as pressurized fluid is delivered by said pump means to said delivery conduit means the fluid will be discharged out through the associated said drain passage means unless the associated said solenoid valve is energized whereby to block flow through said drain passage means so as to allow the pressurized fluid to act on the associated said actuator piston to effect opening of the associated said inlet valve until such time the associated said solenoid valve is again de-energized, an N number of fuel injection nozzles, each of said fuel injection nozzles having an apertured spray tip opening into one of said induction passage for discharge of fuel therein and an N number of fuel pump means, each said fuel pump means having an inlet connectable to a source of fuel and an outlet in flow communication with an associated fuel injection nozzle and being operative by movement of an associated said actuator piston to effect pressurization and delivery of fuel to its associated said fuel injection nozzle.

* * * * *